United States Patent [19]

Morganson et al.

[11] 4,149,977

[45] Apr. 17, 1979

[54] TREATMENT OF FABRICS IN MACHINE DRYERS

[75] Inventors: Stephen A. Morganson, St. Paul; Richard C. Christenson, Bloomington, both of Minn.

[73] Assignee: Economics Laboratory, Inc., St. Paul, Minn.

[21] Appl. No.: 868,302

[22] Filed: Jan. 10, 1978

[51] Int. Cl.[2] ..... D06M 13/34

[52] U.S. Cl. ..... 252/8.8; 206/0.5; 252/8.7; 252/8.9

[58] Field of Search ..... 252/8.8 R, 8.7, 8.9; 206/0.5

[56] References Cited

U.S. PATENT DOCUMENTS

| | | | |
|---|---|---|---|
| 2,590,659 | 3/1952 | Skalkeas | 252/8.7 |
| 3,632,396 | 1/1972 | Zamora | 252/8.8 |
| 3,814,627 | 6/1974 | Marshall et al. | 252/8.9 |
| 3,948,387 | 4/1976 | Haerfle | 206/0.5 |
| 3,993,573 | 11/1976 | Gloss | 252/8.8 |
| 4,004,685 | 1/1977 | Mizuno et al. | 206/0.5 |
| 4,051,046 | 9/1977 | Diehl et al. | 252/8.6 |

*Primary Examiner*—William E. Schulz

*Attorney, Agent, or Firm*—Merchant, Gould, Smith, Edell, Welter & Schmidt

[57] ABSTRACT

Fabrics are treated in machine drying apparatus to reduce static electricity carried by the fabrics, soften the fabrics and improve other fabric properties. A reusable dispenser of solid or semi-solid fabric-conditioning agent is placed in the dryer drum and tumbled with the fabrics in the dryer thereby causing some of the fabric-conditioning agent to be transferred to the fabric. The fabric-conditioning agent comprises a fabric conditioner, a softening point modifier, and a viscosity modifier. When the dryer is heated, the heat of the dryer helps cause the fabric-conditioning agent to soften and assist in its distribution over the surface of fabric with which it is brought into tumbling contact.

16 Claims, 5 Drawing Figures

FIG. 1
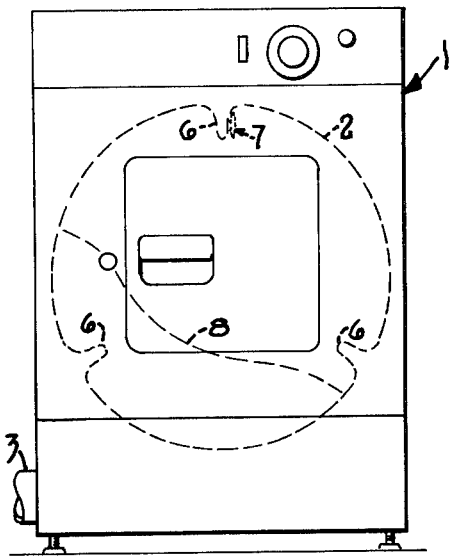
FIG. 2
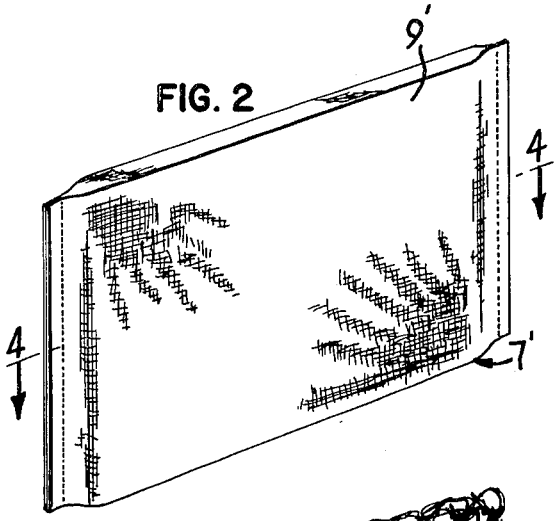
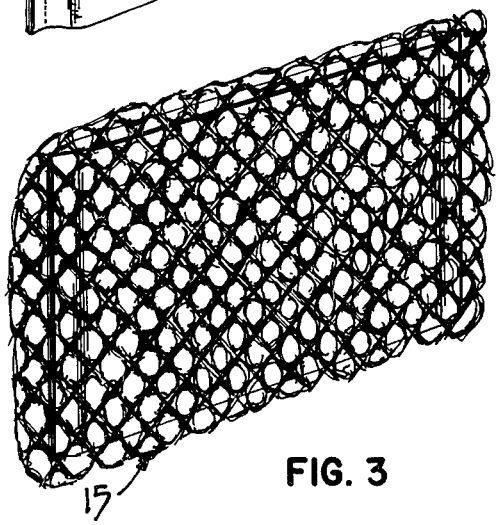
FIG. 3
FIG. 4
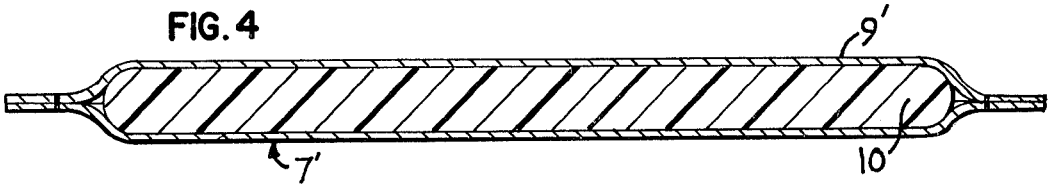
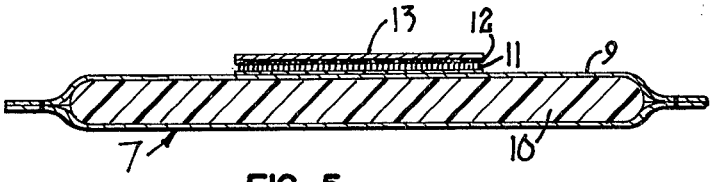
FIG. 5

TREATMENT OF FABRICS IN MACHINE DRYERS

BACKGROUND OF THE INVENTION

In laundering it is common to treat various types of fabrics such as wool, cotton, silk, nylon, polyester, permanent-press, and the like with chemicals which are fabric-conditioning or treating agents to render the fabrics soft to the touch, to reduce tangling, knotting or wrinkling, to render them free of static electricity, to render them bacteria-resistant, to deodorize them, and to otherwise condition them. The use of fabric conditioners permits dried clothes to be sorted and folded more easily and quickly. These results historically were achieved by introducing an aqueous solution or dispersion of a fabric-conditioning agent into the wash water during the wash cycle of the laundry process or by introducing such an aqueous solution or dispersion of fabric-conditioning agent into the rinse water during the rinsing cycle of the laundry process. In addition to the inconvenience of measuring out a liquid material, there can be a number of drawbacks associated with the use of fabric-conditioning agents during the laundry rinse cycle, including the need to remember when to add the material in the case of those washing machines which have no automatic dispenser. Other drawbacks include waste of material and adverse ecological effects (from fabric softening material lost to the drain), the possibility of redeposition of soil during the deep rinse cycle, and the possibility of undesirable interactions between anionic detergents and cationic softeners.

While the use of liquid fabric-conditioning agents in machine dryers has been suggested, the idea has not gained widespread commercial acceptance probably because of such factors as the need for complex dispensing equipment.

To overcome the problems associated with using fabric-conditioning agents during the wash or rinse cycle or with using liquid fabric-conditioning agents during the drying cycle a number of means and techniques have been developed for dispensing fabric conditioners in machine laundry dryers.

Spray systems have been devised for spraying fabric softening agent into a dryer drum before putting fabrics into the dryer so that the fabric-conditioning agent will rub off the drum onto the fabrics during the drying process; however, this can lead to the build up of sticky residue on the inside of the dryer drum, leading to corrosion of the drum. Such residues can also cause plugging of the vent filters.

Means and techniques for dispensing solid fabric conditioners in machine dryers have also been developed. For example, flexible substrates coated or impregnated with fabric softening agents have been designed for use with machine dryers and are currently commercially available. For example, see U.S. Pat. Nos. 3,686,025 (Morton) issued Aug. 22, 1972; 3,632,396 (Perez-Zamora) issued Jan. 4, 1972; and 3,442,692 (Gaiser) issued May 6, 1969. Articles of commerce based on this patented technology have generally been pre-measured, single-use, disposable sheets which can be expensive to use. Another problem associated with these coated or impregnated substrates has been the possibility that they may mark or stain clothes in the dryer. One way to decrease the possibility of marking and staining has been to coat the flexible substrate with a solid softening composition which will remain solid throughout the normal operating temperature range of a dryer (e.g. 45–80° C.). The flexing of the flexible substrate which accompanies the tumbling action of a dryer drum is presently believed to cause the coating of the chemical agent to develop a flaking action, resulting in the transfer of the agent to the clothes in the form of tiny solid flakes or crystals. These flakes of solid agent are considered less likely to cause staining as compared to an agent which is molten or significantly softened within the 45–80° C. range. This coated flexible substrate approach is believed to be best suited for single-use flexible sheets which are separated from the dryer load after the drying cycle and then discarded.

Attaching coated substrates to the interior of the dryer drum, instead of allowing them to tumble freely in the dryer, has also been suggested. For example, see U.S. Pat. No. 3,634,947 (Furgal) issued Jan. 18, 1972. This technique eliminates the need to sort through the dried fabric to locate the substrate which is to be discarded.

More recently, reusable permeable dispensers for dispensing solid or semi-solid fabric-conditioning agents which can either be attached to the dryer drum or tumbled loosely in the dryer have been developed. For example, see U.S. Pat. Nos. 3,870,145 (Mizuno) issued Mar. 11, 1975; 3,948,387 (Haertle) issued Apr. 6, 1976; 4,004,685 (Mizuno et al) issued Jan. 25, 1977; and 4,014,432 (Clothier et al) issued Mar. 29, 1977. These dispensers have generally used conditioning agents which are solid at room temperature and which soften and permeate the dispenser when heated to the operating temperature range of dryers. A broad softening point range for the conditioning agent used in desirable and has been obtained by using a blend of coconut monoethanolamide (melting point of 62–65° C.) dimethyl di (hydrogenated tallow) ammonium chloride (melting point of 139–144° C.), and stearyl dimethyl benzyl ammonium chloride (melting point of 59–65° C.) to form a mixture having a softening point range of 53–85° C. For example, see Example I of U.S. Pat. No. 4,004,685 (Mizuno) issued Jan. 25, 1977. Dispensers of this type have been generally produced by mixing the individual ingredients in their solid state to form a powdered mixture which is used to fill cloth bags having a permeable surface. A filled bag is then heated to cause the powdered mixture to soften and to fuse together, the composition is then cooled to form a hard bar of fabric softener which adheres to the walls of the bag.

If the fabric softener does not sufficiently permeate the permeable surface during the heating step or if additional steps are not taken to assure sufficient permeation, the dispenser may not dispense sufficient softening agent during its initial use; one or more drying cycles being required to cause the softening agent to sufficiently permeate the bag so that a sufficient quantity will be dispensed during a drying cycle. A problem associated with a production process utilizing powder fills has been the inconsistency of fill from bag to bag, which occurs when volumetric filling is used, because of the compressibility of the powder. Another problem with powder filling is that segregation of the individual ingredients may occur prior to filling and cause the percentage of the ingredients to vary from bag to bag.

At the normal operating temperature of many dryers (e.g. 50–90° C.), it has been shown in U.S. Pat. No. 4,004,685 that extremely well-controlled metering of the fabric-softening agent occurs, thereby permitting reuse for a large number of cycles (e.g. more than 5 or 10 cycles) with the assurance that a uniform amount or dosage of fabric softener will be dispensed to each load placed in the dryer—at least after the first two or three cycles of use. However, in recent years machine dryers have become more sophisticated and may be provided with "air-dry" and delicate fabric cycles which use drying temperatures ranging down to room temperature (20–25° C.). On the other hand, if the operating thermostat of these sophisticated dryers should fail, so that only the safety thermostat is operative, drying temperatures above 90° C. may occur, e.g. 100° or even 120° C. Thus, these sophisticated machines may require a fabric softener dispensing means with greater flexibility including the ability to dispense softening agents at broader temperature ranges without increasing the danger of marking and staining at higher drying temperatures.

SUMMARY OF THE INVENTION

The present invention is based on the discovery that by blending a fabric conditioner, a softening point modifier, and a melt-viscosity modifier, an improved fabric conditioning composition for use with a reusable fabric softener dispenser having a permeable surface can be obtained. The fabric conditioning composition of this invention has improved softening and viscosity characteristics which results in more uniform dispensing at preferred dispensing rates over a wide range of dryer temperatures, e.g. from 40° C. temperatures up to 95° C.; yet, the danger of marking or staining of fabrics at the higher end of this temperature range has not been significantly increased. The composition of this invention may be heated until it is in a softened state and placed in individual permeable dispensers in its softened state, thereby avoiding or minimizing some of the production problems associated with powder filling.

Briefly described, the method of the present invention involves placing within the dryer a three-dimensional consolidated mass (as contrasted to a coated substrate or a powder having discrete particles) of heat softenable material comprising, for example, an anti-static agent. This mass of solid fabric conditioner is contained within a dispenser, a portion of which is permeable so that the fabric conditioner can be released through the dispenser when it is softened by the heat of the dryer. For example, a heated semi-solid or softened mass (as contrasted to a powder) of anti-static composition can be placed in a closely woven fabric envelope sealed on 3 edges, which, after filling with the heat softened mass, is sealed on the 4th edge. The heat softened mass is then allowed to cool and consolidate into a bar or other three-dimensional mass. The fabric can be woven or non-woven because the principal requirement of the envelope is that it have a permeable portion, and a wide variety of fabrics can be selected to provide the appropriate degree of permeability. Nonpermeable portions of the envelope, if any, can comprise polymeric film or the like.

A particularly advantageous method of this invention involves mounting the envelope on a leading edge of one of the dryer vanes. However, where attachment to the dryer vane is not practical (e.g. a "community" dryer in an apartment house, a dryer in a self-service laundromat) the cloth envelope can be tumbled with the clothes. Minimization of marking and staining (which can occur if the dispenser comes in direct and prolonged contact with a particular item of clothes) can be accomplished by making the dispenser large enough so that it will not become entrapped in shirt sleeves, etc., by using materials for the envelope which will control the permeability of the chemicals utilized; by varying the chemicals and additives used to control permeability; and/or by enclosing the dispenser in a mesh (e.g. nylon) overwrap which eliminates any direct contact between the dispenser and the clothes being dried. The consolidated, three-dimensional mass is operative throughout the operating temperature range of the dryer and can produce significant softening effects at the lowest drying temperature, e.g. from room temperature to 40° C. When the fabric to be treated is tumbled within the heated dryer drum, anti-static agent passes through pores or interstices in the permeable envelope and is transferred to the fabric.

It has been found that the preferred consumption rate or dispensing rate is about 0.1 gram of fabric conditioning composition for each complete drying cycle (0.1 g/cycle) if observable anti-static effects are to be obtained with a typical dryer and dryer load. For observable fabric softening effects, 0.2 g/cycle is preferred. If the dispensing rate exceeds about 1.2 g/cycle or even 1.0 g/cycle on a consistent basis, marking and staining of fabric has been observed. To reduce the likelihood of marking or spotting of fabric to safe levels, an average dispensing rate below 0.8 g/cycle is particularly preferred. The optimum average minimum dispensing rate is about 0.4 g/cycle. Meaningful average dispensing rates can be obtained by determining the amount of fabric conditioning composition consumed in each of the first five or first ten cycles and then calculating the mean consumption rate, hereinafter referred to as $CR_5$ for the first 5 cycles or $CR_{10}$ for the first ten cycles. The amount consumed in the very first cycle of use (hereinafter referred to as C-1) is also a significant criterion of performance. The C-1 amount should exceed 0.1 gram and preferably 0.2 gram, even if no fabric conditioning agent permeates or wicks through to the outer surface of the dispenser during filling.

BRIEF DESCRIPTION OF THE DRAWINGS

FIG. 1 is a front view of a machine dryer.

FIG. 2 is a perspective view of a cloth dispenser useful in the practice of the present invention.

FIG. 3 is a perspective view of the cloth dispenser of FIG. 2 enclosed with a nylon mesh overwrap.

FIG. 4 is a cross-sectional view of the dispenser shown in FIG. 2 as taken along the line 4—4 in the direction of the arrows.

FIG. 5 is a cross-sectional view of another embodiment of a cloth dispenser which includes a means for attaching the dispenser to a dryer drum.

DETAILED DESCRIPTION

METHOD OF TREATING FABRICS

The present method of treating fabrics in machine dryers can be understood by referring to the following description when read in conjunction with the drawings.

In FIG. 1 is shown machine dryer 1. Dryer 1 includes a heat source (not shown) which may be electric, gas, or other. Dryer 1 is provided with a rotating drum 2 and an exhaust 3.

Rotating drum 2 of dryer 1 is typically provided with a plurality of vanes 6 which extend inwardly from the cylindrical wall of drum 2 and which are generally parallel to the axis of rotation of drum 2. Although drum 2 might rotate in either direction, it has arbitrarily been shown in FIG. 1 to rotate in a clock-wise direction. A dispenser 7 is carried by one of the vanes 6. The purpose of dispenser 7 is to distribute a fabric-conditioning agent onto fabric 8 being tumbled within drum 2. As shown in FIG. 1, dispenser 7 is secured to a leading edge of one of the vanes 6. However, if desired, several dispensers 7 can be attached to a single vane 6 or several dispensers 7 can be attached to different vanes 6. Dispenser 7 can be loosely tumbled with the clothes or other fabric 8 (i.e. it does not need to be attached to the drum), however, attaching dispenser 7 to the drum 2 avoids the disadvantage of having to separate dispenser 7 from the clothes 8 after each dryer load. Moreover, various placements of the dispenser 7 on drum 2 can be used to alter dispensing rates or compensate for different dryer types, makes, temperatures, drying cycles, and the like.

In operation, fabric 8 (usually damp and ready to be dried) is placed within drum 2 and the fabric 8 (e.g. clothes) is tumbled within dryer 1 by rotation of drum 2. In this manner, the fabric 8 is brought into repeated contact with a dispensing surface of dispenser 7. The heat from the dryer causes the fabric-conditioning agent to soften and be transferred to the fabric 8 by contact between the tumbling fabric 8 and the dispensing surface of dispenser 7.

It has been observed that after a dispenser has been used (e.g. a cloth or bag dispenser), beneficial antistatic properties can be obtained by merely tumbling dry clothes in an unheated dryer. Presumably, fabric conditioner which is on the outer surface of the dispenser is transferred to the fabric through abrading contact with the fabric.

THE DISPENSER

The detials of construction of dispenser 7 of FIG. 1. are shown in more detail in FIG. 5; dispenser 7 consists of an outer envelope or shell 9, at least a portion of which must either expose or be permeable to the bar or other mass of fabric-conditioning agent which is in the form of a three-dimensional mass. (The term "three-dimensional", as used herein, means a shape with a significant axis and/or thickness dimension, as opposed to a coating, where the thickness dimension is insignificant compared to the surface area.) It is convenient and economical to construct envelope 9 from cloth or fabric (whether woven or non-woven). Cotton/polyester, for example DACRON (trademark), twill is a particularly effective material of construction. The material of construction can also be varied to control the rate of migration or penetration of the chemicals utilized through the material. The envelope or shell 9 contains bar 10 of solid or semi-solid material comprising a fabric-conditioning agent. Bar 10 is preferably formulated to be solid at room temperature but flowable in a non-Newtonian sense at elevated temperatures below 100° C., as will be more fully hereinafter described. Secured to one side of dispenser 7 is means for selectively attaching the dispenser 7 to one of the dryer vanes 6. This means of attachment comprises a mateable woven hook 11 and loop 12 fastener. The loop portion 12 of the fastener is desirably attached to a double-faced, pressure-sensitive adhesive pad 13. Where it is not necessary to remove and reattach a dispenser, a layer of pressure-sensitive adhesive can be provided on envelope 9, e.g. by attaching a piece of plastic film (not shown) to a major surface of envelope 9 and coating the adhesive layer onto this film. Alternatively, some means for attaching the dispenser 7 could be carried by the drum 2. Any number of snap or other type fasteners which would permit easy and convenient fastening and unfastening of the dispenser 7 can be used.

An alternate embodiment, dispenser 7′ is shown in FIGS. 2 and 4. As shown in FIGS. 2 and 4, dispenser 7′ is essentially the same as dispenser 7 except it does not have means for attaching it to the dryer drum. Dispenser 7′, when in use, would be loosely tumbled with the clothes or other fabric being dried. As shown in FIGS. 2 and 4, dispenser 7′ consists of an outer envelope or shell 9′, at least a portion of which must either expose or be permeable to the fabric-conditioning agent which is in the form of a three-dimensional, consolidated mass, in this case bar 10′. In one practice of this invention the outer envelope or shell 9′ of dispenser 7′ can be enclosed in mesh overwrap 15 as shown in FIG. 3. Mesh overwrap 15 controls the direct contact between dispenser 9′ and clothes being dried and thus minimizes the staining or marking of clothes and serves to give the envelope additional rigidity when bar 10′ is in a softened state.

FABRIC CONDITIONING COMPOSITIONS

The fabric-conditioning compositions useful in the practice of the present invention are those chemicals used for fabric-conditioning, particularly fabric conditioners, which can be formed into a consolidated, three-dimensional solid or semi-solid (i.e. gel-like), mass which will soften or remain softened when heated in a laundry dryer.

In formulating any mass containing a fabric conditioner the mass should be capable of being softened (have a softening point range) within the operating temperature range of the dryer. The desirable operating range for most dryers is 45–80° C., however, some dryers may operate at temperatures below 45° C. or above 80° C. To accurately control the average dispensing rate or consumption rate (CR), U.S. Pat. No. 4,004,685 contemplates the use of fabric conditioning compositions having a broad softening point range. This approach to the problem of a controlled consumption rate is not available if one chooses a liquid fill (as opposed to powder fill) production technique. The fabric conditioning compositions of the present invention (unlike those of U.S. Pat. No. 4,004,685) can be considered to be in a molten state at dryer operating temperatures, and without the viscosity modifier (e.g. an inorganic thixotropic agent) to control the dispensing rate through modification of the rheological properties of the molten composition (e.g. viscosity), the CR can become erratic or excessive. Thus, the fabric conditioning compositions used in this invention have a liquid-fill capability, due to the presence of a significant amount of softening point modifier. They can be made to flow at temperatures well below 100° C., e.g. 45–95° C. Changes in the properties of the composition may occur during storage for prolonged periods at 95° C. or higher, and the optimum fill temperature is normally less than 90° C. (194° F.). The amount of viscosity modifier added to the composition should be sufficient to ensure uniformity of CR (averaged over 10 or more cycles) and to avoid an excessively high CR (e.g. not above 1.2 g/cycle), but not so large an amount as to result in a CR below 0.1 or 0.2 g/cycle. Assuming no significant wicking-through of the molten fabric conditioning composition during filling of the dispensing device, an unacceptably low CR (e.g. below 0.1 g/cycle) is most likely to occur in the first drying cycle. Yet, from the standpoint of consumer acceptance, the very first drying cycle is the most important.

Ordinarily, extensive wicking-through (permeation) of the permeable surface of the dispenser device is a risky way to avoid low consumption rates in the first cycle or first few cycles of dryer operation. The fabric softening composition can cause discoloration of the dispenser or packages containing the dispenser. In the present invention, permeation of the aforementioned permeable surface is unnecessary and is preferably avoided or inhibited. Inhibition of this permeation effect can be accomplished by filling at lower temperatures (e.g. below 80° or 85° C., more preferably below 75° C.), and by treating the fabric envelope 9 of dispenser 7 with a hydrophobic and olephobic organic polymer, e.g. a fluorinated polymer such as "Scotchguard" (trademark of 3M Company). The combination of the softening point modifier and melt-viscosity modifier with the fabric conditioning agent provides an adequate, well-controlled, uniform CR beginning with the first cycle and extending through 10 to 40 or more cycles of dryer operation.

To further avoid excessive wicking-through of the fabric softening composition, the fabric conditioners used in the composition of this invention are preferably solids at room temperature, however, liquid fabric conditioners which can be mixed with a non-interfering carrier to form a heat softenable solid or can otherwise be formed into a suitable gel can be used. Nonionic and amphoteric surfactants are known to have antistatic and softening characteristics, however, cationic surfactants are the most widely used fabric conditioners. A particularly useful class of cationic fabric conditioners are the quaternary ammonium salts. Desirably such quaternary salts will be chlorides and will contain at least one and usually two $C_{12}$–$C_{24}$ fatty acid radicals (e.g. $C_{18}$ radicals). The most widely used quaternary ammonium salts are those which have two long alkyl groups and two short alkyl groups, for example dialkyl dimethyl ammonium chlorides. One readily available and preferred fabric conditioner is dimethyl di (hydrogenated tallow) ammonium chloride. If desired, two or more fabric conditioners can be blended together.

When the softening point of the fabric conditioner or mixture of fabric conditioners is above the dryer operating range, such as with dimethyl di (hydrogenated tallow) ammonium chloride (melting point of 139°–144° C.), a softening point depressant should be included in the fabric-conditioning composition. Although almost any softening or melting point depressant could be used, it is generally desirable to use one which will also increase the viscosity of the resulting softened mixture. Preferred softening point depressants include $C_8$–$C_{10}$ monoethanolamides, coconut monoalkanol amides, sorbitan esters, monoalkanolamine, and lauric isopropanol amide. A particularly preferred softening point depressant for use in the composition of this invention is coconut monoethanolamide. Softening point depressants will generally comprise 3% to 25% of the total composition, preferably 10–20%.

As previously indicated it is desirable that the fabric softening composition of this invention have a stable, controlled viscosity throughout its softening range to assure uniform dispensing over a range of temperatures. A number of viscosity modifiers can thicken or control the viscosity of quaternary compounds, some of which are organic (e.g. carboxymethyl cellulose, hydroxyethyl cellulose, starch) and some of which (the preferred type) are inorganic. The inorganic viscosity control agents are typically finely divided minerals or oxides (clays, asbestos, silica, etc.), including treated minerals (amine-treated, silica-treated, etc.). Among the commercially available amine-treated clays are the "Bentones" (trademark of National Lead Co.). Where desirable, a mixture of viscosity modifiers can be used. All inorganic viscosity modifiers do not work with equal effectiveness, and it is much preferred to use "fumed" silicon dioxide which can be used to impart a relatively constant viscosity to a fabric conditioning composition over at least a substantial portion of its softened or molten state, e.g. at 40° C. to 80° C. The "fumed" silica viscosity modifiers are colloidal-like particulate masses made by hydrolysis of a silicon tetrahalide. The average size of the particles in these colloidal masses is well below one micron and typically below 0.1 micron. Such colloidal silica is commercially available as, for example, CAB-O-SIL (trade-mark). When used, viscosity modifiers will generally comprise 1 to 10 weight-% of the total composition, preferably 2–6% depending on the amount of softening point modifier used. For example, if less than 10 wt.-% softening point modifier is used, the amount of viscosity modifier can be less than 5 wt.-%, more typically not more than 2.5 wt.-%. On the other hand, if 15–25 wt.-% softening point modifier is used, even 2.5% viscosity modifier is likely to be insufficient, and 3–8% may be needed.

Additional additives can be used to improve bar-forming characteristics, modify the softening range of the bar and to control the rate of migration or penetration of the fabric conditioner through the permeable surface of dispenser 7 and 7'. Perfumes can also be included in the composition of this invention and when included will generally comprise up to 10% of the composition, preferably 1–3%.

So that the envelope portion of the dispenser device will reliably contain enough fabric conditioning composition for at least 10 dryer cycles, it is preferred that the envelope contain more than 5 grams, more typically 10–25 grams of the composition. For typical home-dryer use, amounts in excess of 22 grams are unnecessary, and 25 or more (e.g. 25–40) well-controlled applications of fabric conditioning composition can be reliably obtained with 14–20 grams of the composition enclosed in a suitable envelope.

A preferred composition of the present invention could include 65–95% fabric conditioner, 3% to 25% softening point depressant, and 1–10% viscosity modifier. One currently preferred formula comprises (by weight) 77% dimethyl di (hydrogenated tallow) ammonium chloride, 18% coconut monoethanolamide, 2.5% fumed silica, and 2.5% perfume. Another currently preferred formula comprises 76 wt.-% dimethyl di (hydrogenated tallow) ammonium chloride, 18 wt.-% coconut monoethanolamide, 3.5 wt.-% fumed silica, and 2.5 wt.-% perfume.

METHOD OF MANUFACTURE

In the preferred method for manufacturing a dispenser article 7 of this invention, an envelope 8 is fashioned from fabric rendered oleophobic and hydrophobic with agents such as "Scotchguard" (trademark). The envelope is unsealed along one edge and is held in a generally horizontal or vertical position. The fabric conditioning composition is kept in a reservoir maintained at 35°–85° C., preferably 55°–75° C., the storage temperature being selected so as to impart viscous-liquid flow characteristics to the composition. About 5 to 25 grams of the hot, viscous liquid is poured from the reservoir through the unsealed edge into the envelope. The sealing of the envelope can then be completed. The fill temperature, the level of olephobicity of the fabric, and the nature of the fabric conditioning composition are all selected so as to control the "wicking-through" phenomenon described previously.

The present invention is further illustrated by the following specific Example. Unless otherwise indicated, all parts and percentages are by weight.

EXAMPLE 1

This Example was designed to compare the "CR" (consumption rate, i.e. grams of fabric conditioning composition consumed per cycle) of several softening agent compositions containing varying percentages of a fabric conditioner, a softening point modifier, and a viscosity modifier; 2.5 percent perfume was also included in each of the compositions tested.

The fabric conditioner used was dimethyl di (hydrogenated tallow) ammonium chloride (melting point of 139°-144° C.), available from Ashland Chemical Company under the trademark "Adogen 442". The softening point depressant used was coconut monoethanolamide (melting point of 62°-65° C.) available from Mona Industries under the trademark "Monamid CMA". The viscosity modifier used was a colloidal silicon dioxide (melting point of 1710° C.), available from Cabot Corporation under the trademark "Cab-O-Sil M-5".

The nine compositions tested are listed in Table I.

TABLE I

| | FORMULATIONS | | | |
|---|---|---|---|---|
| Formulation Number | Coconut Mono-ethanolamide | Fumed Silicon Dioxide | Dimethyl di (hydrogenated) tallow) Ammonium Chloride | Per-fume |
| 1 | 10.0% | 3.5% | 84.0% | 2.5% |
| 2 | 14.0% | 2.0% | 81.5% | 2.5% |
| 3 | 14.0% | 5.0% | 78.5% | 2.5% |
| 4 | 18.0% | 3.5% | 76.0% | 2.5% |
| 5 | 14.0% | 3.5% | 80.0% | 2.5% |
| 6 | 18.0% | 5.0% | 74.5% | 2.5% |
| 7 | 10.0% | 5.0% | 82.5% | 2.5% |
| 8 | 10.0% | 2.0% | 85.5% | 2.5% |
| 9 | 18.0% | 2.0% | 77.5% | 2.5% |

The formulations in Table I were prepared by mixing the quantities of each component necessary to achieve the indicated percentages.

Six dispensers for each composition (a total of 54 dispensers) were each prepared by folding over a piece of white 65% Dacron (trademark)/35% cotton twill fabric measuring approximately 2 inches by 3⅜ inches, so that a finished envelope was formed; the envelope was sealed so that only one edge remained unsealed. Fifteen grams of each composition were then placed in each of six bags and the bags were sealed shut.

Next, each of the 54 dispensers were tested separately by attaching it to a dryer vane along with a normal load of damp fabric and drying the fabric in the usual manner. The drying cycle was repeated 10 times at a dryer operating temperature of 150° to 160° F. (65°-71° C.) with each dispenser, and the consumption rate for each cycle was determined by weighing the dispenser before and after each cycle and determining the weight loss. The data obtained is summarized in Table II. Each of the figures for the individual cycles is an average of six tests. (Each cycle lasted approximately 55 minutes).

TABLE II

| | TEN CYCLE CONSUMPTION TESTS | | | | | | | | |
|---|---|---|---|---|---|---|---|---|---|
| | FORMULATION NUMBER | | | | | | | | |
| Cycle | 1 | 2 | 3 | 4 | 5 | 6 | 7 | 8 | 9 |
| 1 | .0611 | .0023 | .0115 | .7001 | .0308 | .2703 | .0878 | .1898 | .9981 |
| 2 | .0694 | .2927 | .0501 | .5229 | .4089 | .5048 | .0826 | .4865 | .9127 |
| 3 | .1462 | .4307 | .1528 | .6535 | .5251 | .3710 | .1206 | .5430 | .7945 |
| 4 | .1540 | .4366 | .2189 | .5614 | .4894 | .4833 | .2268 | .5294 | .5900 |
| 5 | .1877 | .5728 | .2560 | .4314 | .4457 | .5056 | .1516 | .5018 | .5603 |
| 6 | .1509 | .4092 | .2731 | .4748 | .4604 | .4156 | .2320 | .5507 | .6169 |
| 7 | .2515 | .5329 | .3221 | .3616 | .4294 | .4400 | .2503 | .4799 | .4352 |
| 8 | .2278 | .4210 | .1964 | .3739 | .2986 | .4015 | .2570 | .4314 | .4566 |
| 9 | .1653 | .4615 | .2347 | .4515 | .3270 | .2784 | .2256 | .3310 | .3904 |
| 10 | .1783 | .3142 | .3183 | .3543 | .3314 | .2822 | .2266 | .3620 | .4784 |
| Average ($CR_{10}$) | .1592 | .3874 | .2034 | .4890 | .3747 | .3952 | .1861 | .4405 | .6233 |

All of the above figures are weight loss in grams per cycle and consist of an average of six tests. Dryer operating temperature (e.g. temperature of gases in the vent) typically ranged from 65° to 71° C.

It will be noted that only Formulas 4, 6, 8, 9, and (marginally) 7 dispensed sufficient fabric conditioner to provide anti-static conditioning in the first cycle. Of these five formulas, only Formulas 4, 6, and 9 would be expected to reliably provide both anti-static and fabric softening effects in the first cycle. When considering the mean consumption rate over the first ten cycles ($CR_{10}$), both Formulas 4 and 9 exceed 0.4 g/cycle, which is preferred; however, the mean consumption rate over the first three cycles ($CR_3$) for Formula 9 is well above 0.8 g/cycle, thus increasing the risk of marking or staining.

The data in Tables I and II was subjected to the statistical technique called "regression analysis" to determine the mathematical correlation between consumption rate and the formulation levels of coconut monoethanolamide and fumed silicon dioxide. "Regression analysis" uses a computer to determine the mathematical equation which described or "best fits" the relation between consumption and formulation. The equation developed was: $CR_{10}=0.9134-0.7774CMA+0.003855CMA^2-0.074FSD$. Where $CR_{10}$=Mean Consumption Rate in grams/cycle, averaged over the first ten cycles; CMA=percent by weight of Coconut Monoethanolamide; and FSD=percent by weight of Fumed Silicon Dioxide.

As indicated below in Table III (which simply combines and reorganizes the data from Tables I and II) increasing the percentage of coconut monoethanolamide from 10% to 18%, while keeping the percentage of fumed silicon dioxide constant, generally causes an increase in the average consumption per cycle. Also as indicated in Table III, increasing the percentage of fumed silicon dioxide from 2 to 5%, while keeping the percentage of coconut monoethanolamide constant, generally causes a decrease in the average consumption per cycle.

TABLE III

| EFFECT OF INCREASING PERCENTAGE OF FUMED SILICON DIOXIDE ON CONSUMPTION | | | | |
|---|---|---|---|---|
| | | PERCENTAGE OF FUMED SILICON DIOXIDE | | |
| | | 2.0% | 3.5% | 5.0% |
| PERCENTAGE OF COCONUT MONOETHANOL-AMIDE | 10.0% | .440 | .159 | .186 |
| | 14.0% | .387 | .375 | .203 |

TABLE III-continued

| EFFECT OF INCREASING PERCENTAGE OF FUMED SILICON DIOXIDE ON CONSUMPTION | | | |
|---|---|---|---|
| | PERCENTAGE OF FUMED SILICON DIOXIDE | | |
| | 2.0% | 3.5% | 5.0% |
| 18.0% | .623 | .489 | .395 |

EXAMPLE 2

The effect of varying the fumed silica inorganic thixotrope ("Cab-O-Sil M-5") content of the fabric conditioning composition was investigated using a G.E. dryer (150°–160° F. or about 65°–71° C. dryer operating temperature). The formulas listed below are designated 2-0, 2-2, 2-4, 2-6, 2-8, and 2-10 to easily identify the percent by weight of "Cab-O-Sil" (trademark) used.

| | AMOUNTS OF INGREDIENTS (%) | | | | | |
|---|---|---|---|---|---|---|
| | 2-0 | 2-2 | 2-4 | 2-6 | 2-8 | 2-10 |
| Fumed silica | — | 2.0 | 4.0 | 6.0 | 8.0 | 10.0 |
| DMDTAC* | 79.5 | 77.5 | 75.5 | 73.5 | 71.5 | 69.5 |
| CMA** | 18.0 | 18.0 | 18.0 | 18.0 | 18.0 | 18.0 |
| Perfume | 2.5 | 2.5 | 2.5 | 2.5 | 2.5 | 2.5 |

*Dimethyl di (hydrogenated tallow) ammonium chloride
**Coconut monoethanolamide

The "consumption rates" (grams consumed per cycle) were as follows.

| DRYER | GRAMS PER CYCLE CONSUMED FOR FORMULAS 2-0 THROUGH 2-10 | | | | | |
|---|---|---|---|---|---|---|
| CYCLE | 2-0 | 2-2 | 2-4 | 2-6 | 2-8 | 2-10 |
| First | 0.81 | 0.66 | 0.30 | 0.11 | 0.03 | 0.02 |
| Second | 2.33 | 1.35 | 0.64 | 0.29 | 0.07 | 0.02 |
| Third | 1.82 | 1.31 | 0.63 | 0.38 | 0.12 | 0.07 |
| Fourth | 2.52 | 1.33 | 0.75 | 0.40 | 0.14 | 0.08 |
| Fifth | 2.23 | 1.10 | 0.62 | 0.34 | 0.15 | 0.08 |
| $CR_5$* | 2.02 | 1.15 | 0.59 | 0.30 | 0.10 | 0.06 |

*Mean consumption rate per cycle, averaged over the five cycles, 55 minutes per cycle.

It should be noted that $CR_5$ is inversely related to % fumed silica; however, the relationship is not simple and is certainly non-linear.

What is claimed is:

1. The method of conditioning fabrics which comprises the steps of:

(a) placing a fabric-conditioning composition as a consolidated, reusable three-dimensional form, which form is solid or semi-solid at normal room temperature, within the drum of a machine dryer, said drum including a rotatable cylindrical drum wall, said composition being in a form which is heat softenable at temperatures within the operating temperature range of the dryer; said composition comprising a fabric conditioner, a softening point modifier, and a viscosity modifier; and said composition being enclosed within a dispenser body having a permeable surface through which about 0.1–1.2 grams of said enclosed fabric-conditioning composition can pass during each and every dryer cycle when it is softened by heating of said dispenser body in a dryer and when it is in contact with a tumbling load of fabric in the dryer, thereby allowing the enclosed fabric-conditioning composition to act as a long lasting reservoir for fabric-conditioning composition which, after it passes through the permeable surface, is transferred to the load being treated by contact between the load and the permeable surface of the dispenser body;

(b) drying and conditioning a dryer load by carrying out a drying cycle which includes the step of tumbling said dryer load in said dryer by rotation of said cylindrical drum wall, thereby causing about 0.1–1.2 grams of said composition to pass through said permeable surface and be transferred to the surfaces of fabric in the load by contact between the tumbling load and the permeable portion of said dispenser body;

(c) repeating said step (b) at least ten times, using the same dispenser of said step (a) as a reservoir for said composition, by tumbling other dryer loads in said dryer, whereby about 0.1–1.2 grams of said composition passes through said permeable surface and is transferred to the fabric in each load with each repetition of said step (b).

2. The method of conditioning fabrics which comprises the steps of:

(a) placing a fabric-conditioning composition as a consolidated, reusable three-dimensional form, which form is solid or semi-solid at normal room temperature, within the drum of a machine dryer, said drum including a rotatable cylindrical drum wall, said composition being in a form which is a non-Newtonian, molten fluid at a temperature below 85° C.; said composition comprising a cationic fabric conditioner having a softening point above the dryer operating temperature range; a softening point depressant for said cationic fabric softener; and an essentially inorganic viscosity modifier; and said composition being enclosed within a dispenser body having a permeable surface through which about 0.1–1.2 grams of said enclosed fabric-conditioning composition can pass during each and every dryer cycle when it is softened by heating of said dispenser body in a dryer and when it is in contact with a tumbling load of fabric in the dryer, thereby allowing the enclosed fabric-conditioning composition to act as a long lasting reservoir for fabric-conditioning composition which, after it passes through the permeable surface, is transferred to the load being treated by contact between the load and the permeable surface of the dispenser body;

(b) drying and conditioning a dryer load by carrying out a drying cycle which includes the step of tumbling said dryer load in said dryer by rotation of said cylindrical drum wall, thereby causing about 0.1–1.2 grams of said composition to pass through said permeable surface and be transferred to the surfaces of fabric in the load by contact between the tumbling load and the permeable portion of said dispenser body;

(c) repeating said step (b) at least ten times, using the same dispenser of said step (a) as a reservoir for said composition, by tumbling other dryer loads in said dryer, whereby about 0.1–1.2 grams of said composition passes through said permeable surface and is transferred to the fabric in each load with each repetition of said step (b).

3. The method of claim 2 wherein the fabric-conditioning composition is present as a bar and wherein the permeable portion of the dispenser body comprises fabric treated with an oleophobic polymer.

4. The method of claim 2 wherein the fabric conditioner comprises a quaternary ammonium chloride containing at least one $C_{12}$–$C_{24}$ fatty acid radical.

5. The method of claim 4 wherein the viscosity modifier is essentially thixotropic.

6. The method of claim 5 wherein the softening point modifier is an alkanolamide.

7. The method of claim 2 wherein the amount of said composition transferred to said load is at least 0.2 grams in said step (b) and averages 0.4–1.0 grams in each said repetition of step (b).

8. The method of claim 7 wherein said fabric conditioner comprises dimethyl di(hydrogenated tallow) ammonium chloride; wherein said softening point modifier comprises coconut monoethanolamide; and wherein said viscosity modififer comprises fumed silicon dioxide.

9. The method of claim 8 wherein said fabric-conditioner composition comprises, by weight:

(a) about 65–96% dimethyl di(hydrogenated tallow) ammonium chloride;

(b) about 3–25% coconut monoethanolamide; and (c) about 1–10% fumed silicon dioxide.

10. The method of claim 9 wherein said coconut monoethanolamide comprises about 10–20% of the composition and wherein the fumed silicon dioxide comprises about 2–5% of the composition.

11. The method of claim 10 wherein said fabric conditioning composition consists essentially of, by weight:

(a) 76% dimethyl di(hydrogenated tallow) ammonium chloride;

(b) 18% coconut monoethanolamide;

(c) 3.5% fumed silicon dioxide; and (d) 2.5% perfume.

12. The method of claim 2 wherein said fabric conditioning composition comprises, by weight:

(a) 65–95% fabric conditioner;

(b) 3–25% softening point depressant; and (c) 1–10% viscosity modifier.

13. The method of claim 2 wherein said step (a) includes the step of attaching said fabric-conditioning composition dispenser to a portion of said dryer drum.

14. An article for conditioning fabrics in a machine clothes dryer by contact of the fabrics with a fabric-conditioning composition supplied by said article, said article characterized by having:

(a) a fabric-conditioning composition comprising a quaternary ammonium salt, a monoethanolamide, and colloidal silica;

(b) a dispenser body surrounding or enclosing the fabric-conditioning composition;

(c) said dispenser body including a permeable outer surface through which 0.1–1.2 gram of said enclosed fabric-conditioning composition can pass when said composition is softened by heating of said article in a dryer, thereby allowing the enclosed fabric-conditioning composition to act as a long lasting reservoir for said fabric-conditioning composition which, after it passes through the permeable surface, is transferred to the fabric being treated by contact between the fabric and the permeable surface of the article; and (d) said article being capable of substantial reuse in conditioning different batches of fabric without replenishing the fabric-conditioning composition of paragraph (a) hereof;

said fabric-conditioning composition of paragraph (a) hereof being selected to:

provide a mean consumption rate of at least 0.1 gram per dryer use or cycle, averaged over the first ten dryer uses of said article, and provide a passing through, from said reservoir through said permeable outer surface, of at least 0.1 gram of said fabric-conditioning agent in the first said dryer use of said article.

15. The article of claim 14 wherein said composition comprises:

(a) 65–95% dimethyl di(hydrogenated tallow) ammonium chloride;

(b) 3–25% coconut monoethanolamide; and (c) 1–10% fumed silicon dioxide;

and wherein said composition is selected to provide a mean consumption rate of at least 0.4 gram per dryer cycle or use, averaged over the first ten dryer uses of said article.

16. The article of claim 15 wherein said dispenser body has been filled with said fabric conditioning composition while said composition was an essentially non-Newtonian molten fluid and at a temperature below 85° C., and wherein the molten composition is inhibited from wicking through said permeable outer surface during filling.

* * * * *

UNITED STATES PATENT AND TRADEMARK OFFICE

CERTIFICATE OF CORRECTION

PATENT NO. : 4,149,977

DATED : April 17, 1979

INVENTOR(S) : Stephen A. Morganson and Richard C. Christenson

It is certified that error appears in the above-identified patent and that said Letters Patent are hereby corrected as shown below:

Column 2, line 32, for "in" read --is--.
Column 3, line 5, "delicate fabric" should be in quotes --"delicate fabric"--.
Column 5, line 36, for "detials" read --details--.
Column 8, line 20, for "trade-mark" read --trademark--.
Column 9, line 6, for "olephobicity" read --oleophobicity--.
Column 9, line 55, for "3 3/8" read --3 5/8--.
Column 13, line 16, for "modififer" read --modifier--.
Column 13, line 21, for "96" read --95--.

Signed and Sealed this

*Eleventh* Day of *September 1979*

[SEAL]

*Attest:*

*Attesting Officer*

LUTRELLE F. PARKER

*Acting Commissioner of Patents and Trademarks*